US005158668A

United States Patent [19]

Chahar et al.

[11] Patent Number: 5,158,668

[45] Date of Patent: Oct. 27, 1992

[54] PREPARATION OF RECARBURIZER COKE

[75] Inventors: Bharat S. Chahar, Ponca City; John K. Shipley, Stillwater, both of Okla.

[73] Assignee: Conoco Inc., Ponca City, Okla.

[21] Appl. No.: 818,724

[22] Filed: Jan. 6, 1992

Related U.S. Application Data

[63] Continuation of Ser. No. 454,090, Dec. 18, 1989, abandoned, which is a continuation-in-part of Ser. No. 257,600, Oct. 13, 1988, abandoned.

[51] Int. Cl.[5] ..... C01G 69/02; C01G 69/06

[52] U.S. Cl. ..... 208/50; 208/57; 208/61; 208/89; 208/131; 502/85

[58] Field of Search ..... 208/50, 58, 61, 67, 208/72, 57, 89, 131; 502/85

[56] References Cited

U.S. PATENT DOCUMENTS

| | | | |
|---|---|---|---|
| 3,702,816 | 11/1972 | Buchmann et al. | 208/50 |
| 4,036,736 | 7/1977 | Ozaki et al. | 208/106 |
| 4,043,898 | 8/1977 | Kegler | 208/131 |
| 4,075,084 | 2/1978 | Skripek et al. | 208/93 |
| 4,108,798 | 8/1978 | Sze et al. | 208/125 |
| 4,478,949 | 10/1984 | Kaeding | 502/85 |
| 4,547,284 | 10/1985 | Sze et al. | 208/131 |
| 4,604,185 | 8/1986 | McConaghy et al. | 208/56 |
| 4,604,186 | 8/1986 | Lutz et al. | 208/50 |
| 4,661,241 | 4/1987 | Dabkowski et al. | 208/131 |
| 4,720,338 | 1/1988 | Newman et al. | 208/50 |
| 4,762,608 | 8/1988 | Didchenko et al. | 208/89 |
| 4,792,390 | 12/1988 | Staggs et al. | 208/58 |
| 4,814,063 | 3/1989 | Murakami et al. | 208/50 |
| 4,894,144 | 1/1990 | Newman et al. | 208/50 |
| 4,983,559 | 1/1991 | Berrebi | 502/85 |

FOREIGN PATENT DOCUMENTS

| | | | |
|---|---|---|---|
| 3721245 | 2/1988 | Fed. Rep. of Germany | 208/50 |

*Primary Examiner*—Anthony McFarlane

[57] ABSTRACT

Recarburizer coke containing not more than 0.1 weight percent sulfur and not more than 0.1 weight percent nitrogen is prepared by the catalytic hydrogenation, thermal cracking, and delayed coking of a mixture of pyrolysis tar and petroleum distillate.

23 Claims, 1 Drawing Sheet

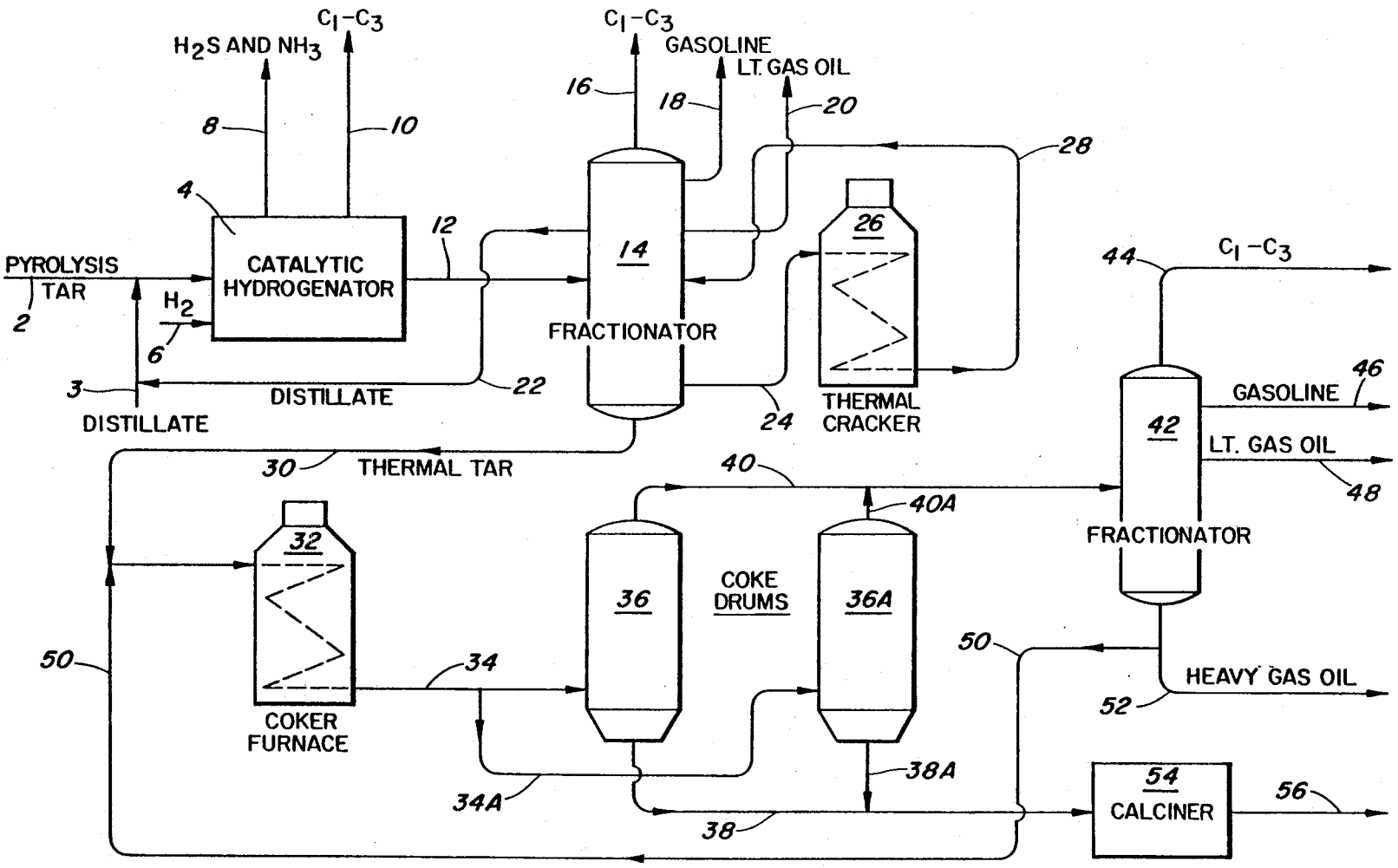
PYROLYSIS TAR
2
3
DISTILLATE
$H_2$
6
4
CATALYTIC HYDROGENATOR
8
$H_2S$ AND $NH_3$
10
$C_1-C_3$
12
22
DISTILLATE
14
FRACTIONATOR
16
$C_1-C_3$
18
GASOLINE
20
LT. GAS OIL
24
26
THERMAL CRACKER
28
THERMAL TAR
30
32
COKER FURNACE
34
34A
36
COKE DRUMS
36A
38
38A
40
40A
50
50
42
FRACTIONATOR
44
$C_1-C_3$
46
GASOLINE
48
LT. GAS OIL
52
HEAVY GAS OIL
54
CALCINER
56

PREPARATION OF RECARBURIZER COKE

RELATED APPLICATIONS

This application is a continuation of application Ser. No. 07/454,090 filed Dec. 18, 1989 now abandoned which is a continuation-in-part of application, Ser. No. 07/257,600; filed Oct. 13, 1988, now abandoned.

BACKGROUND AND SUMMARY OF THE INVENTION

Low sulfur recarburizer coke is a type of coke used in the production of high quality steels. Its purpose is to increase the carbon content of the steel without introducing any extraneous contaminants, especially sulfur and nitrogen. Historically, steel producers and recarburizer marketers have used crushed scrap graphite (graphitized premium coke) as the major source of recarburizer coke. However, this source has steadily declined as scrap rates in the graphite electrode production, and electric arc furnaces have been reduced. A market now exists for alternative sources of recarburizer coke with very low levels of contaminants.

It would be possible, of course, to manufacture high quality, premium coke, calcine and graphitize this material and use it as recarburizer coke. However, premium coke is too valuable in its use as electrodes for the manufacture of steel and, it would be uneconomic to use this material as recarburizer coke. Prior to graphitization, premium coke usually contains substantial amounts of sulfur and nitrogen, up to 0.3 to 0.5 or higher weight percent sulfur and nitrogen in similar quantities. Thus, ungraphitized premium coke would not be suitable for use as recarburizer coke even if economics would permit its use. Another type of coke which is manufactured in substantial quantities is so called aluminum grade coke, that is, coke which is used in manufacturing electrodes for use in the production of aluminum. This coke also contains substantial amounts of sulfur and nitrogen which make it unsuitable for use as recarburizer coke.

It has been found that pyrolysis tar can be processed to produce recarburizer coke. In order to use pyrolysis tar for this purpose, it first must be subjected to hydrogenation to reduce the sulfur and nitrogen content of the tar. Unfortunately, hydrotreating of pyrolysis tars can cause reactor bed plugging and a high rate of heat generation in the reactor, which makes it difficult to control the reactor temperatures.

In accordance with this invention, a mixture of pyrolysis tar and petroleum distillate is catalytically hydrogenated to reduce the sulfur and nitrogen content to low levels, the hydrotreated tar is then thermally cracked to provide a thermal tar which is subjected to delayed coking and the delayed coke is calcined to provide a recarburizer coke product containing not more than 0.1 weight percent sulfur and not more than 0.1 weight percent nitrogen. The process of the invention is effected without reactor bed plugging and without a high rate of heat generation in the reactor.

The Prior Art

U.S. Pat. No. 4,446,004 shows a process for upgrading residual oils by hydrotreating the residual oils, fractionating the hydrotreated residual oils and thermal cracking the 850° F. fraction.

U.S. Pat. No. 4,466,883 hydrodesulfurizes a coker gas oil and a pyrolysis tar to produce premium coke. The coking process comprises a heat soaking step, thermal cracking, flashing to separate a pitch-type residue, fractionation of the flashed oil to obtain a bottoms fraction and subjected the bottoms fraction to delayed coking to obtain needle coke.

U.S. Pat. No. 4,500,416 shows a process for preparing oil distillates by thermal cracking a catalytically hydrotreated deasphalted feed. All coke-forming materials are removed during the treatment process.

U.S. Pat. No. 3,475,327 shows the hydrodesulfurization of blended feedstocks, which blended stock is hydrofined to reduce sulfur content and then fractionated to recover a gasoline fraction, a reformer feedstock fraction, and a heating oil fraction.

U.S. Pat. No. 3,501,545 shows the hydrotreatment of sulfur containing tar for reducing coke. The tar is diluted with benzene before hydrotreatment.

U.S. Pat. No. 3,817,853 shows coking a pyrolysis tar to make premium coke after subjecting the tar to mild hydrogenation. The tar may be admixed with an inert diluent such as petroleum distillate during hydrogenation.

BRIEF DESCRIPTION OF THE DRAWING

The drawing is a schematic diagram of a process unit which illustrates the invention.

DETAILED DESCRIPTION OF THE INVENTION

The present invention resides in a process for producing low sulfur recarburizer coke. In particular, a mixture of pyrolysis tar and petroleum distillate is catalytically hydrogenated with a hydrogenation catalyst which comprises an inorganic refractory oxide support or matrix composited with a metal or mixture of metals selected from the Group VIB or Group VIII metals of the Periodic Table and mixtures thereof.

The pyrolysis tar used in the process of the invention may be any tar produced by high temperature thermal cracking in pyrolysis furnaces to produce low molecular weight olefins. In general, olefins comprising primarily ethylene and lesser amounts of propylene, butene, and isobutylene are produced by the severe cracking of petroleum distillates or residues at temperatures from about 1200° to about 1800° F., preferably from about 1300° to about 1600° F. at pressures from atmospheric to about 15 psig and in the presence of a diluent gas. Typical diluents employed are low boiling hydrocarbons such as methane, ethane, or propane, although steam is preferred and is the most commonly used diluent. Ethane and propane can also serve as the cracking stock. The products of the cracking operation are predominantly olefinic gases such as ethylene, propylene, and butene. A heavy pyrolysis tar is obtained from this cracking operation and is removed with the effluent and separated by condensation. The pyrolysis tar has a high olefinic content and is therefore unstable to subsequent heating since it has a tendency to deposit coke prematurely in the heating tubes of furnaces employed for its subsequent conversion. This material, however, also has an appreciable content of aromatic hydrocarbons.

The petroleum distillate which is combined with the pyrolysis tar to form the combined feedstock used in the practice of the invention may be any of a number of distillates either straight run or cracked including such materials as naphtha, kerosene, diesel oil, light gas oil, heavy gas oil, FCC cycle oil, etc. Although all of the petroleum distillates may be used with pyrolysis tar to effect the purpose of the invention, namely to prevent reactor bed plugging and high rate of heat generation in the reactor, some distillates are preferred over others. Every hydrogenation catalyst used to process mixtures of pyrolysis tar and distillate gradually becomes deactivated over a period of time. However, the rate of deactivation is much lower when the lighter distillates are used. Accordingly, although materials such as heavy gas oil may be used with the pyrolysis tar, its use will be accompanied by a greater catalyst deactivation rate than will occur with lower boiling petroleum distillates, which are therefore preferred.

The amount of pyrolysis tar and the amount of distillate used in the combined feed will vary depending on the hydrogenation conditions and the particular distillate which is used. Since catalyst deactivation is greater with heavier distillates, such distillates are added to the pyrolysis tar in greater amounts than would be used with lower boiling distillates. In general, the pyrolysis tar to distillate ratio will be between about 15:1 and about 1:2 and preferably between about 8:1 and about 1:1.

The hydrogenation catalysts herein preferably comprise an inorganic refractory oxide support or matrix composited with a metal or mixture of metals selected from the Groups VIB or VIII of the Periodic Table. The inorganic refractory oxide support or matrix preferably is selected from gamma alumina or an aluminosilicate molecular sieve, e.g. Y zeolite.

The inorganic refractory oxides herein are preferably ion exchanged with a metal selected from the Group VIB and VIII metals and mixtures thereof as disclosed by the Periodic Table. Group VIB metals particularly suitable for use herein include chromium, molybdenum or tungsten and mixtures thereof. The preferred Group VIB metals herein are chromium and molybdenum. The Group VIII metals herein are preferably selected from the group consisting of iron, cobalt, nickel, ruthenium, rhodium, palladium, osmium, iridium or platinum and mixtures thereof. Especially preferred mixtures of metals herein include molybdenum and nickel or molybdenum and cobalt deposited on an inorganic refractory oxide support. The metals disclosed herein may be in salt form, acid form or introduced into the inorganic refractory oxide as an oxide. Especially desirable salt forms of the metals herein include the metal chlorides and metal nitrates.

The metals are conveniently deposited on the inorganic refractory oxides by the incipient wetness technique. For example, an aqueous solution of metal salt is formed and the inorganic refractory oxide is immersed in the solution. The metal impregnated inorganic refractory oxide is then dried, normally under vacuum, at a temperature of from about 250° C. to about 500° C. for from about one hour to about 5 hours.

Normally, the Group VIB or VIII metals or mixtures thereof comprise from about 1 weight percent to about 30 weight percent, preferably from about 3 weight percent to about 20 weight percent, especially from about 5 weight percent to about 16 weight percent of the inorganic refractory oxide support or matrix. When more than one metal is incorporated into the catalyst, they may be mixed in any molar ratio, so long as the weight percentages remain in the above. described ranges.

The final hydrogenation catalyst is characterized as having an average pore diameter of from about 60 angstroms to about 340 angstroms, preferably from about 80 angstroms to about 340 angstroms; a surface area of from about 50 $M^2/g$ to about 550 $M^2/g$, especially from about 100 $M^2/g$ to about 350 $M^2/g$; a pore volume of from about 0.2 cc/g to about 0.9 cc/g, preferably from about 0.4 cc/g to about 0.8 cc/g; and a compacted bulk density of from about 0.45 to about 0.85, especially from about 0.50 to about 0.65.

The hydrogenation catalyst herein are preferably activated by contacting said catalyst with, for example, tertiarnonyl polysulfide, carbon disulfide, or dimethyl sulfide in the presence of a diesel fuel stream at a temperature of from about 350° F. to about 700° F., preferably from about 350° F. to about 600° F., at a pressure of from about 300 psig to about 900 psig, especially from about 400 psig to about 800 psig.

Referring now to the drawing, pyrolysis tar feed to the process is introduced to catalytic hydrogenator 4 via line 2, with hydrogen being provided to the hydrogenator through line 6. The catalyst used in hydrogenator 4 comprises an inorganic refractory oxide support or matrix composited with a Group VIB or Group VIII metal or mixtures thereof.

The hydrotreating process conditions employed may be summarized as follows:

| Hydrotreating Conditions | | |
|---|---|---|
| | Broad Range | Preferred Range |
| Temperature - °F. | about 500–800 | about 600–750 |
| Pressure - psig | about 500–1500 | about 600–1200 |
| $H_2$/Oil - SCFB | about 500–4000 | about 1000–3000 |
| LHSV | 0.2–6 | 0.5–2 |

The particular process conditions employed for hydrogenation will depend on the pyrolysis tar feedstock and the distillate which is combined with the pyrolysis tar. Optimum reaction conditions for any given combined feedstock are basically an economic evaluation which depends on specific process objectives which form no essential part of the invention. For purposes of the present invention, the critical hydrotreating requirements are simply that the overall conditions must be selected to effect sufficient desulfurization of the feed and removal of nitrogen from the feed to provide an ultimate recarburizer coke product containing not more than 0.1 weight percent sulfur and not more than 0.1 weight percent nitrogen, and preferably not more than 0.05 weight percent sulfur and not more than 0.05 weight percent nitrogen.

It should be noted that recarburizer coke is used in the production of steel. Normally the recarburizer coke is dumped into a steel melt, normally in a batch operation, in a process to produce steel. The migration of sulfur and/or nitrogen from the steel melt, e.g. such as what would occur if high sulfur and nitrogen content recarburizer coke is used in the process, would serve to inhibit and disrupt the bonding necessary to produce high quality steel.

The hydrogen and nitrogen which are removed from the combined feed in the hydrogenation step are taken overhead from the catalytic hydrogenator through line 8. The hydrogen is removed as such and the nitrogen usually in the form of ammonia. In addition light gases $C_1$ to $C_3$ are removed from the hydrogenator through line 10. The remaining liquid effluent from the hydrogenator is transferred via line 12 to fractionator 14 from which light gases, gasoline, and light gas oil are taken off overhead or as side products through lines 16, 18 and 20, respectively. In addition, a light petroleum distillate boiling between gasoline and light gas oil is removed from fractionator 14 through line 22 and comprises at least part of the distillate which is combined with the pyrolysis tar prior to hydrogenation. As necessary, additional distillate of a similar boiling range may be introduced for combination with the pyrolysis tar via line 3. A heavy material usually having a boiling range above about 500° F. is removed from fractionator 14 through line 24 and introduced to thermal cracker 26. In thermal cracker 26, temperatures of about 900° to 1100° F. and pressures of about 300 to 800 psig are maintained whereby this heavy material is converted to lighter compounds and to a thermal tar containing less hydrogen, higher aromatics and a higher carbon residue than the feed to the thermal cracker. Effluent from the thermal cracker is then recycled via line 28 to fractionator 14.

A thermal tar which comprises a major portion of coking components is withdrawn from the bottom of fractionator 14 through line 30 and introduced to coker furnace 32 wherein it is heated to temperatures in the range of about 875° to 975° F. at pressures from about atmospheric to about 250 psig and is then passed via line 34 to coke drums 36 and 36A. The coke drums operate on alternate coking and decoking cycles of about 16 to about 100 hours; while one drum is being filled with coke the other is being decoked. During the coking cycle, each drum operates at a temperature between about 850° and about 950° F. and a pressure from about 15 to about 200 psig. The overhead vapor from the coke drums is passed via line 40 or 40A to fractionator 42 while coke is removed from the bottom of coke drums through outlet 38 or 38A. The material entering fractionator 42 is separated into several fractions, a gaseous material which is removed through line 44, a gasoline fraction removed through line 46 and a light gas oil which is removed via line 48. Heavy coker gas oil is removed from the bottom of fractionator 42 and is sent to storage through line 52. If desired, a portion or all of this material may instead be recycled through line 50 to coker furnace 32.

The green coke which is removed from the coke drums through outlets 38 and 38A is introduced to calciner 54 where it is subjected to elevated temperatures to remove volatile materials and to increase the carbon to a hydrogen ratio of the coke. Calcination may be carried out at temperatures in the range of between about 2000° and about 3000° F. and preferably between about 2400° and about 2600° F. The coke is maintained under calcining conditions for between about ½ hour and about 10 hours and preferably between about 1 and about 3 hours. The calcined coke which contains less than 0.1 percent sulfur and less than 0.1 percent nitrogen and preferably less than 0.05 percent sulfur and less than 0.05 percent nitrogen is withdrawn from the calciner through outlet 56 and is suitable for use as recarburizer coke.

The following examples illustrate the results obtained in carrying out the invention.

EXAMPLE 1

A 75:25 blend of pyrolysis tar and light cycle oil from an FCC unit were subjected to hydrotreating in a pilot plant in the presence of a nickel-molybdenum on alumina hydrogenation catalyst. Properties and composition of the feed materials are shown in Table 1. The hydrotreating conditions and product properties are given in Table 2.

TABLE 1

| | Light Cycle Oil | Pyrolysis Tar | Combined Feed |
|---|---|---|---|
| API Gravity | 21.9 | −3.8 | 1.2 |
| Sulfur - Wt % | 0.39 | 0.30 | 0.314 |
| Nitrogen - ppm | 570 | 200 | 330 |
| Boiling Range - °F. | 271–666 | 457–843 | 271–823 |
| Recovery - Vol % | 98 | 70 | 76 |

TABLE 2

| Run No. | 1 | 2 | 3 |
|---|---|---|---|
| Reactor Temperature - °F. | 710 | 710 | 710 |
| Reactor Pressure - psig | 760 | 760 | 760 |
| LHSV - 1/hr | 0.90 | 1.0 | 1.0 |
| $H_2$/Oil Ratio - SCFB | 3000 | 3000 | 3000 |
| Product Properties | | | |
| API Gravity | 7.6 | 8.0 | 7.3 |
| Sulfur - Wt % | 0.026 | 0.027 | 0.030 |
| Nitrogen - ppm | 75 | 90 | 98 |

EXAMPLE 2

An 85:15 blend of the same feed materials as in Example 1 was subjected to hydrotreating under similar conditions. The resulting product properties are shown in Table 3.

TABLE 3

| Run No. | 1 | 2 | 3 |
|---|---|---|---|
| Product Properties | | | |
| API Gravity | 7.2 | 6.7 | 6.9 |
| Sulfur - Wt % | 0.035 | 0.031 | 0.037 |
| Nitrogen - ppm | 77 | 95 | 103 |

EXAMPLE 3

A 50:50 blend of pyrolysis tar and heavy coker gas oil was hydrotreated under the same conditions as employed in Example 1 except for LHSV which ranged from 0.75 to 0.89. The combined feed contained 0.364 weight percent sulfur and 0.14 weight percent nitrogen due primarily to the large amount of sulfur and nitrogen in the heavy gas oil. The hydrotreated product from several runs ranged from 0.151 to 0.047 weight percent sulfur and from 0.083 to 0.048 weight percent nitrogen.

Hydrotreater catalyst bed plugging did not occur in any of Examples 1, 2 and 3. Also there was no evidence of high heat generation in the reactor.

The rate of catalyst deactivation in terms of the change in °F./week of hydrogenation temperature required to provide a product sulfur content of 0.075 weight percent was determined for the 50:50 blend of pyrolysis tar and heavy coker gas oil and the 75:25 blend of pyrolysis tar and light cycle oil. The catalyst deactivation rate for the 50:50 blend was 9° F./week as compared to 2° F./week for the 75:25 blend.

Thus, while both blends provided satisfactory hydrogenator operation the heavier petroleum distillate deactivated the catalyst at a much higher rate, indicating the desirability of using lighter petroleum distillate as a component of the combined feed.

EXAMPLE 4

A 75:25 blend of pyrolysis tar and light cycle oil from an FCC unit was hydrogenated utilizing a nickel-molybdenum on alumina catalyst to provide a product having an API gravity of 14.9 and containing 0.035 weight percent sulfur and 95 ppm nitrogen. The product was topped at 720° F. to remove light materials and the topped heavy fraction, which contained 0.054 weight percent sulfur and 191 ppm nitrogen, was delay coked at an equivalent drum vapor temperature of about 880° F. and 60 psig for 8 hours. The coked product contained 0.030 weight percent sulfur and 140 ppm nitrogen. The yield of coke based on the pyrolysis tar feed to the hydrogenator was 17.7 weight percent.

EXAMPLE 5

410 Barrels/hr of a 75:25 blend of pyrolysis tar and light cycle oil petroleum distillate having a boiling range of 270° to 666° F. were subjected to hydrogenation in the presence of a cobalt-molybdenum on silica alumina hydrogenation catalyst at a temperature of 723° F., a pressure of 795 psig, a hydrogen/oil ratio of 5050 SCF/B and an LHSV of 0.9 l/hr. The hydrotreated feed was introduced to a fractionator where lighter fractions, e.g. gas, gasoline and light gas oil were removed. Another stream was removed from the fractionator to provide the petroleum distillate used in the pyrolysis tar-distillate blend. 292 Barrels/hr of a heavy fraction having a boiling range of 500°to 1000° F. was taken from the lower portion of the fractionator and passed through a thermal cracking furnace maintained at temperature and pressure of 910° to 950° F. and about 400 psig. The cracked effluent from the furnace was returned to the fractionator. A thermal tar having an API gravity of −2.1 and an initial boiling point of 700° F. (50 to 55 percent recovery) was withdrawn from the bottom of the fractionator at a rate of 150 barrels/hr and introduced to a coker furnace maintained at a temperature of 945° F. and a pressure of 200 psig. Effluent from the coker furnace was introduced to delayed cokers operating in sequence wherein coking was carried out at a temperature of 875° F. and a pressure of 60 psig for 24 hours. Green coke in the amount of 18.6 tons/hr was removed from the delayed cokers and calcined at 2500° F. for 0.8 hours to provide 15.8 tons/hr of recarburizer coke having a sulfur content of 0.05 weight percent and a nitrogen content of 300 ppm.

The non-coke effluent from the delayed coker was taken to a fractionator where various fractions, including $C_1$ to $C_3$ gases, gasoline and light gas oil were recovered. Heavy gas oil bottoms from the fractionator in the amount of 68 barrels/hr was recycled to the coker furnace.

The yield of recarburizer coke based on the pyrolysis tar feed to the hydrogenator was 31.1 weight percent.

Comparing Examples 4 and 5, it is noted that the yield of recarburizer coke is substantially increased by thermal cracking the heavy effluent from the hydrogenation treatment prior to coking.

EXAMPLE 6

A pyrolysis tar was subjected to hydrogenation in the presence of a nickel-molybdenum on silica alumina catalyst. Properties and composition of the feed material are shown in Table 4. The hydrotreating conditions and product properties from representative 24-hour runs are shown in Table 5.

TABLE 4

| Pyrolysis Tar Feed | |
|---|---|
| API Gravity | −6.9 |
| Sulfur - Wt % | 0.21 |
| Nitrogen - Wt % | 0.07 |
| Boiling Range - °F. | 533-842 |
| Recovery - Vol % | 53 |

TABLE 5

| Run No. | 1 | 10 | 30 | 43 | 62 | 82 | 112 |
|---|---|---|---|---|---|---|---|
| Reactor Temp - °F. | 650 | 700 | 700 | 650 | 700 | 700 | 700 |
| Reactor Pressure - psig | 400 | 400 | 400 | 1600 | 1600 | 400 | 400 |
| LHSV - 1/hr | 0.589 | 0.601 | 0.594 | 0.588 | 0.600 | 0.590 | 0.637 |
| $H_2$/Oil Ratio - SCFB | 3000 | 3000 | 3000 | 3000 | 3000 | 3000 | 3000 |
| Product Properties | | | | | | | |
| API Gravity | −4.4 | −4.0 | −5.2 | −1.2 | −1.6 | −6.0 | −5.7 |
| Sulfur - Wt % | 0.11 | 0.07 | 0.07 | 0.03 | 0.05 | 0.10 | 0.11 |
| Nitrogen - Wt % | 0.03 | 0.03 | 0.04 | 0.029 | 0.026 | 0.04 | 0.05 |

The runs were terminated at 3418 hours due to reactor bed plugging. During the runs the preheater to the reactor plugged with carbonaceous material and had to be cleaned several times.

The change in °F./week of hydrogenation temperature required to provide a product sulfur content of 0.075 weight percent was determined to be 11° F. per week. This compares to the 9° F. per week for the pyrolysis tar—heavy coker gas oil feed of Example 3 and the 2° F. per week for the pyrolysis tar—light cycle oil feed of Example 1.

EXAMPLE 7

A U.S. sweet atmospheric resid (650° F.+) was hydrotreated in a pilot plant to produce a hydrotreated resid (liquid properties and hydrotreating conditions are shown in table 6 below). The sulfur and nitrogen contents of the hydrotreated sweet resid are very low and imply that a good quality LSR coke could be made form this feed.

TABLE 6

| Feedstock Description | U.S. Sweet Resid | Hydrotreated U.S. Sweet Resid |
|---|---|---|
| Properties | | |
| API Gravity | 23.3 | 26.7 |
| Sulfur, wt % | 0.60 | 0.07 |
| Nitrogen, wt % | 0.09 | 0.04 |
| Conradson Carbon Residue, wt % | 3.11 | 1.32 |
| Boiling Range, °F. (D-1160) | 73 to 969 | 2 to 972 |
| Hydrotreating Conditions | | |
| Temperature, °F. | | 750 |
| Pressure, psig | | 1500 |
| LHSV, 1/hr | | 0.90 |
| H2/Oil Ratio, SCFB | | 3000 |
| Chemical H2 Consumption SCFB | | 415 |
| Hydrodesulfurization, % | | 88 |
| Hydrodenitrogenation, % | | 56 |

TABLE 6-continued

| Feedstock Description | U.S. Sweet Resid | Hydrotreated U.S. Sweet Resid |
|---|---|---|
| Green Coke | | |
| Coke Yield, wt % | 7.4 | 4.4 |
| Sulfur, wt % | 1.87 | 0.45 |
| Coking | | |
| Reaction Time = 8 hrs<br>Pressure = 60 psig | Equiv DVT = 870° | |

The hydrotreated sweet resid was delay coked at an equivalent drum vapor temperature of 870° F. at a pressure of 60 psig for 8 hours. The coke yield (based on the whole hydrotreated feed) was 4.4 weight %. The coke contained 0.45 weight % sulfur which is obviously above the limit for LSR coke of 0.1 weight %. In addition the hydrogenation catalyst bed experienced substantial plugging after a short period of time.

EXAMPLE 8

An Indonesian sweet resid was also hydrotreated at conditions similar to the U.S. sweet resid (liquid properties and hydrotreating conditions are shown in Table 7). The hydrotreated Indonesian resid has very low sulfur and nitrogen levels which suggest that it would be a suitable feed for LSR coke.

TABLE 7

| Feedstock Description | Indonesian Sweet Resid | Hydrotreated Indonesian Sweet Resid |
|---|---|---|
| Properties | | |
| API Gravity | 28.2 | 30.7 |
| Sulfur, wt % | 0.11 | 0.10 |
| Nitrogen, wt % | 0.20 | 0.02 |
| Conradson Carbon Residue, wt % | 4.47 | 2.62 |
| Boiling Range, °F. (D-1160) | 607 to 949 | 561 to 1050 |
| Hydrotreating Conditions | | |
| Temperature, °F. | | 750 |
| Pressure, psig | | 1500 |
| LHSV, 1/hr | | 0.89 |
| H2/Oil Ratio, SCFB | | 3000 |
| Chemical H2 Consumption SCFB | | 203 |
| Hydrodesulfurization, % | | 82 |
| Hydrodenitrogenation, % | | 50 |
| Green Coke | | |
| Coke Yield, wt % | 8.9 | 4.6 |
| Sulfur, wt % | 0.40 | 0.16 |
| Coking | | |
| Reaction Time = 8 hrs<br>Pressure = 60 psig | Equiv DVT = 870° | |

The hydrotreated Indonesian resid was coked at an equivalent drum vapor temperature of 870° F. at a pressure of 60 psig for 8 hours. It produced only 4.6 weight % coke which contained 0.16 weight % sulfur. This coke is also not acceptable as an LSR coke.

The hydrotreated sweet resids are not useful as low sulfur resid (LSR) coke feeds for two reasons. The low coke yields concentrates all the sulfur and nitrogen containing molecules in the coke. Most of the heteroatom containing molecules in a sweet resid (especially a hydrotreated resid) are in the highest boiling fractions which make most of the coke. It is impractical to remove all of the nitrogen and sulfur from a high content aliphatic/paraffinic resid because it would not make any coke. Straight run sweet resids or any straight run resid are not suitable for making LSR coke.

EXAMPLE 9

FCC slurry oil (268 Barrels/hour) having a boiling range of 550° to 905° F. was hydrotreated in the presence of a nickel-molybdenum on alumina hydrogenation catalyst at a temperature of 736° F. a pressure of 782 psig, and a LHSV of 0.57 1/hr. The hydrotreater was operated to produce a hydrotreated slurry oil with a maximum sulfur content of 0.05 weight %. The properties of the feed and two product samples, hydrotreating and coking conditions and results are shown in table 8 below. The sulfur contents of both products were 0.05 weight % and the nitrogen contents are a little higher at 0.07 to 0.08 weight %. The coke made from the hydrotreated slurry oils at an equivalent drum vapor temperature of 880° F. at a pressure of 60 psig for 8 hours contained less than 0.05 weight % sulfur but more than 0.1 weight % nitrogen (0.170 and 0.184 weight %). This is not an acceptable LSR coke.

TABLE 8

| Feedstock Description | FCC Slurry Oil | Hydrotreated Slurry Oil No. 1 | Hydrotreated FCC Slurry Oil No. 2 |
|---|---|---|---|
| Properties | | | |
| API Gravity | 7.2 | 11.5 | 11.5 |
| Sulfur, wt % | 0.89 | 0.05 | 0.05 |
| Nitrogen, wt % | 0.22 | 0.08 | 0.07 |
| Hydrotreating Conditions | | | |
| Temperature, °F. | | 736 | 736 |
| Pressure, psig | | 782 | 782 |
| LHSV, 1/hr | | 0.57 | 0.57 |
| H2/Oil Ratio, SCFB | | 6436 | 6436 |
| Chemical H2 Consumption SCFB | | 584 | 565 |
| Hydrodesulfurization, % | | 94.4 | 94.4 |
| Hydrodenitrogenation, % | | 63.6 | 68.2 |
| Green Coke | | | |
| Coke Yield, wt % | 15.9 | 10.0 | 10.2 |
| Sulfur, wt % | 0.75 | 0.034 | 0.030 |
| Nitrogen, wt % | | 0.184 | 0.170 |
| Coking | | | |
| Reaction Time = 8 hrs<br>Pressure = 60 psig | | Equiv DVT = 880° F. | |

It should be noted that the molecular constituents of FCC slurry oil contain most of the nitrogen in aromatic rings, thus making it extremely difficult to remove from the oil. The more severe hydrotreating conditions needed to remove the nitrogen from FCC slurry oil would dramatically increase catalyst deactivation and catalyst bed plugging. The change in F./week of the hydrogenation temperature to make a product from the FCC slurry oil with a 0.05 weight % sulfur content was estimated to be 53.2 ° F./week. This compares with a temperature increase of 2° F./week for the pyrolysis tar-light cycle oil feed mixture of Example 1.

While certain embodiments and details have been shown for the purpose of illustrating the present invention, it will be apparent to those skilled in this art that various changes and modifications may be made herein without departing from the spirit or scope of the invention.

We claim:

1. A process for the production of low sulfur and low nitrogen coke which comprises:

(1) combining a pyrolysis tar and a petroleum distillate to obtain a combined feed material, (2) contacting the combined feed material with a gamma alumina or a y zeolite, hydrogenating catalyst comprising an inorganic refractory oxide support or matrix composited with a metal selected from the group consisting of a Group VIB metal, a Group VIII metal and mixtures thereof in the presence of hydrogen and under hydrogenation reaction conditions, said hydrogenating catalyst having been activated by contact with an agent selected from the group consisting of tertiarnonyl polysulfide, carbon disulfide, or dimethyl sulfide and mixtures thereof in the presence of a diesel fuel stream under catalyst activation conditions, (3) subjecting the hydrotreated feed material to thermal cracking, (4) subjecting thermal tar obtained form the thermal cracking step to delayed coking; and (5) recovering a coke product containing not more than 0.10 weight percent sulfur and not more than 0.10 weight percent nitrogen.

2. The process of claim 1 in which the coke product is calcined to obtain a recarburizer coke product containing not more than 0.05 weight percent sulfur and not more than 0.05 weight percent nitrogen.

3. The process of claim 2 in which the petroleum distillate is a cracked or straight run material.

4. The process of claim 3 in which the petroleum distillate is a light cycle oil.

5. The process of claim 3 in which the ratio of pyrolysis tar to petroleum distillate in the combined feed varies from about 15 to 1 to about 1 to 2.

6. The process of claim 1 wherein the catalyst activation conditions comprise a temperature of from about 350° F. to about 700° F. and a pressure of from about 300 psig to about 900 psig.

7. The process of claim 1 wherein the Group VIB metal is a member selected from the group consisting of chromium, molybdenum and tungsten and mixtures thereof.

8. The process according to claim 1 wherein the Group VIII metal is a member selected from the group consisting of iron, cobalt, nickel, ruthenium, rhodium, palladium, osmium, iridium and platinum and mixtures thereof.

9. The process according to claim 1 wherein the metal comprises a mixture of molybdenum and nickel.

10. The process according to claim 1 wherein the metal comprises a mixture of molybdenum and cobalt.

11. The process according to claim 1 wherein the Group VIB or Group VIII metal or mixture thereof comprises from about 1 weight percent to about 30 weight percent of the inorganic refractory oxide support or matrix.

12. The process according to claim 1 wherein the hydrogenation reaction conditions comprise a temperature of from about 500° F. to about 800° F., a pressure of from about 500 psig to about 1,500 psig, a hydrogen to oil ratio of from about 500 to about 4,000 SCF of hydrogen per barrel of oil and a liquid hourly space velocity of from about 0.2 to about 6.

13. A process for the production of low sulfur and low nitrogen recarburizer coke which comprises:

(1) combining a pyrolysis tar and a petroleum distillate to obtain a combined feed material, (2) contacting the combined feed material with a gamma alumina or y zeolite, hydrogenating catalyst comprising an inorganic refractory oxide support or matrix composited with a metal selected from a mixture of a molybdenum and nickel or molybdenum and chromium in the presence of hydrogen and under hydrogenation reaction conditions, said hydrogenating catalyst having been activated by contact with an agent selected from the group consisting of tertiarnonyl polysulfide, carbon disulfide, or dimethyl sulfide and mixtures thereof in the presence of a diesel fuel stream under catalyst activation conditions, (3) introducing effluent form hydrogenation step (2) to a fractionation zone, (4) removing a heavy stream from the fractionation zone in step (3) and subjecting it to thermal cracking, (5) returning effluent from the thermal cracking to the fractionation zone, (6) removing thermal tar from the fractionation zone and subjecting it to delayed coking; and (7) Calcining the resulting coke product to obtain a recarburizer coke containing not more than 0.10 weight percent sulfur and not more than 0.10 weight percent nitrogen.

14. The process of claim 13 in which the petroleum distillate is obtained from the fractionation zone.

15. The process of claim 13 in which the petroleum distillate is a cracked or straight run material.

16. The process of claim 13 in which the petroleum distillate is a light cycle oil.

17. The process according to claim 13 wherein the metal comprises from about 3 weight percent to about 20 weight percent of the inorganic refractory oxide support or matrix.

18. The process of claim 13 in which the catalytic hydrogenation reaction conditions comprise a temperature range of about 600° F. to about 750° F., a pressure of between about 600 and about 1200 psig, a hydrogen/oil ratio of about 1,000 to about 3,000 SCF/barrel and a LHSV of about 0.5 to about 2.

19. The process of claim 13 in which the thermal cracking is carried out at a temperature between about 900° and about 1100° F. and a pressure between about 300 and about 800 psig.

20. The process of claim 13 in which the delayed coking is carried out at a temperature between about 850° F. and about 950° F., a pressure between about 15 psig and about 200 psig and a coking cycle between about 16 and about 100 hours.

21. The process of claim 13 in which the pyrolysis tar from the hydrogenation step contains not more than 0.1 weight percent sulfur and not more than 0.10 weight percent nitrogen.

22. The process of claim 13 in which the ratio of pyrolysis tar to petroleum distillate in the combined feed varies from about 15 to 1 to about 1 to 2.

23. The process of claim 13 wherein the catalyst activation conditions comprise a temperature of from about 350° F. to about 600° F. and a pressure of from about 400 psig to about 800 psig.

* * * * *